United States Patent [19]

Milne

[11] Patent Number: 4,700,197

[45] Date of Patent: Oct. 13, 1987

[54] ADAPTIVE ARRAY ANTENNA

[75] Inventor: Robert Milne, Ottawa, Canada

[73] Assignee: Canadian Patents & Development Ltd., Ottawa, Canada

[21] Appl. No.: 835,191

[22] Filed: Mar. 3, 1986

Related U.S. Application Data

[63] Continuation-in-part of Ser. No. 627,341, Jul. 2, 1984, abandoned.

[30] Foreign Application Priority Data

May 30, 1985 [CA] Canada ..... 482864

[51] Int. Cl.[4] ..... H01Q 3/44

[52] U.S. Cl. ..... 343/837; 343/846

[58] Field of Search ..... 343/832–837, 343/825, 826, 829, 846, 847, 844, 790–792, 701, 853; 342/368, 374, 376, 403, 406

[56] References Cited

U.S. PATENT DOCUMENTS

| | | | |
|---|---|---|---|
| 2,533,078 | 12/1950 | Woodward | 343/790 |
| 3,560,978 | 2/1971 | Himmel et al. | 343/837 |
| 3,725,938 | 4/1973 | Black et al. | 343/836 |
| 3,846,799 | 11/1974 | Gueguen | 343/837 |
| 4,631,546 | 12/1986 | Dumas et al. | 343/833 |

FOREIGN PATENT DOCUMENTS

| | | | |
|---|---|---|---|
| 1616535 | 7/1971 | Fed. Rep. of Germany | 343/833 |

*Primary Examiner*—William L. Sikes
*Assistant Examiner*—Michael C. Wimer
*Attorney, Agent, or Firm*—Yoshiharu Toyooka

[57] ABSTRACT

A small linearly polarized adaptive array antenna for communication systems is disclosed. The directivity and pointing of the antenna beam can be controlled electronically in both the azimuth and elevation planes. The antenna has low RF loss and operates over a relatively large communications bandwidth. It consists, essentially, of a driven λ/4 monopole surrounded by an array of coaxial parasitic elements, all mounted on a ground plane of finite size. The parasitic elements are connected to the ground plane via pin diodes or equivalent switching means. By applying suitable biasing voltage, the desired parasitic elements can be electrically connected to the ground plane and made highly reflective, thereby controlling the radiation pattern of the antenna.

12 Claims, 17 Drawing Figures

——— LOW BEAM MEASURED AT A CONSTANT ELEVATION ANGLE OF 30°

----- HIGH BEAM MEASURED AT A CONSTANT ELEVATION ANGLE OF 45°

ADAPTIVE ARRAY ANTENNA

This is a continuation-in-part of application Ser. No. 06/627,341 filed July 2, 1984 abandoned.

The present invention relates to a small adaptive array antenna for communication systems and, more particularly, is directed to a directional antenna which includes an active element, a plurality of coaxial parasitic elements and means for activating the parasitic elements to change the scattering characteristics of the antenna.

BACKGROUND OF THE INVENTION

One application of the invention is in the domaine of mobile communication systems. Mobile terminals in terrestrial communication systems commonly use a λ/4 monopole whip antenna which provides an omnidirectional pattern in azimuth and an elevation pattern that depends upon the monopole geometry and the size of the ground plane on which it is mounted. Such an antenna has low gain and provides little discrimination between signals received directly and signals reflected from nearby objects. The interference between the direct signal and reflected signal can result in large fluctations in signal level. Normally this does not constitute a problem in terrestrial systems as there is adequate transmitted power to compensate for any reductions in signal strength. With the advent of satellite mobile communications systems, the down-link systems margins, i.e. from satellite to ground terminal, become more critical as the available transmitter power on the spacecraft is limited. Improvements in mobile terminal antenna gain and multipath discrimation can have a major impact on the overall systems design and performance.

An adaptive array antenna, consisting of a plurality of elements, can provide greater directivity resulting in higher gain and improved multipath discrimination. The directivity of the antenna can also be controlled to meet changing operational requirements. Such an antenna has however to acquire and track the satellite when the mobile terminal is in motion.

One type of the array antennas is disclosed in U.S. Pat. No. 3,846,799, issued Nov. 5, 1974, Gueguen. This patent describes an electrically rotatable antenna which includes several radially arranged yagi antennas having a common driven element. More particularly, in the array antenna of the U.S. patent, the common driven element and all the parasitic elements (reflectors and directors) are metal wires having a height of approximately λ/4, λ being the free-space wavelength corresponding to the frequency of the signal fed to the driven element. The parasitic elements are arranged in concentric circles on a ground plane and the common driven element is at the center. Though close to λ/4, the heights of the parasitic elements are different, all wires located on the same circle having the same height. A pin diode connecting a parasitic element and the ground plane is made conducting or non-conducting by bias voltages applied to the diode, through a separate RF choke inductance. By rendering appropriate parasitic elements (reflectors and directors) operative, the radiation beam can be rotated about the common driven element.

While this antenna can rotate the direction of the beam electronically, it suffers from such shortcomings as narrow bandwidth, low gain, high sidelobes and highly inefficient design requiring 288 parasitic elements. Also it can rotate only in the azimuth.

OBJECTS OF THE INVENTION

It is an object of the present invention to provide an adaptive array antenna in which the directivity and pointing of the antenna beam can be controlled electronically, over a relatively wide communications bandwidth, both in the azimuth and elevation planes.

Another object of this invention is that the antenna has small R.F. losses and that the maximum directive gain is close to the theoretical value determined by the effective aperture size.

Another object is that low sidelobe levels can be realized to minimise the degrading effects of multipath signals on the communications and tracking performance.

Another object is that the antenna be capable of handling high transmitter power.

A further object is that the antenna be compact, has a low profile, and is inexpensive to manufacture.

SUMMARY OF THE INVENTION

According to the present invention, a small adaptive array antenna consists of a ground plane formed by an electrical conductive plate and a driven quaterwave (λ/4) monopole positioned substantially perpendicularly to the ground plane. The antenna further includes a plurality of coaxial parasitic elements, each of which is positioned substantially, perpendicularly to but electrically insulated from the ground plane and is further arranged in a predetermined array pattern on the ground plane in relation to each other and to the driven monopole. Each of the coaxial parasitic elements has two ends, the first end being nearer to the ground plane than the second end, and comprises an inner electrical conductor and an outer cylindrical electrical conductor. The inner conductor is within and coaxially spaced from the outer conductor and the both conductors are electrically shorted with each other at the second end. The antenna still further has a plurality of switching means, each of which is connected between the outer cylindrical electrical conductor of each coaxial parasitic element at its first end and the ground plane. A cable is connected to the driven monopole to feed RF energy to it. Each of a plurality of biasing means is electrically connected to the inner electrical conductor of each coaxial parasitic element at its first end and an antenna controller connects the plurality of the biasing means and a bias power supply to cause one or more of the switching means to be either electrically conducting or non-conducting so that the antenna pattern can be altered.

BRIEF DESCRIPTION OF DRAWINGS

The foregoing and other objects and features of the invention may be readily understood with reference to the following detailed description taken in conjunction with the accompanying drawings, in which.

DETAILED DESCRIPTION OF EMBODIMENTS

Figure 1:
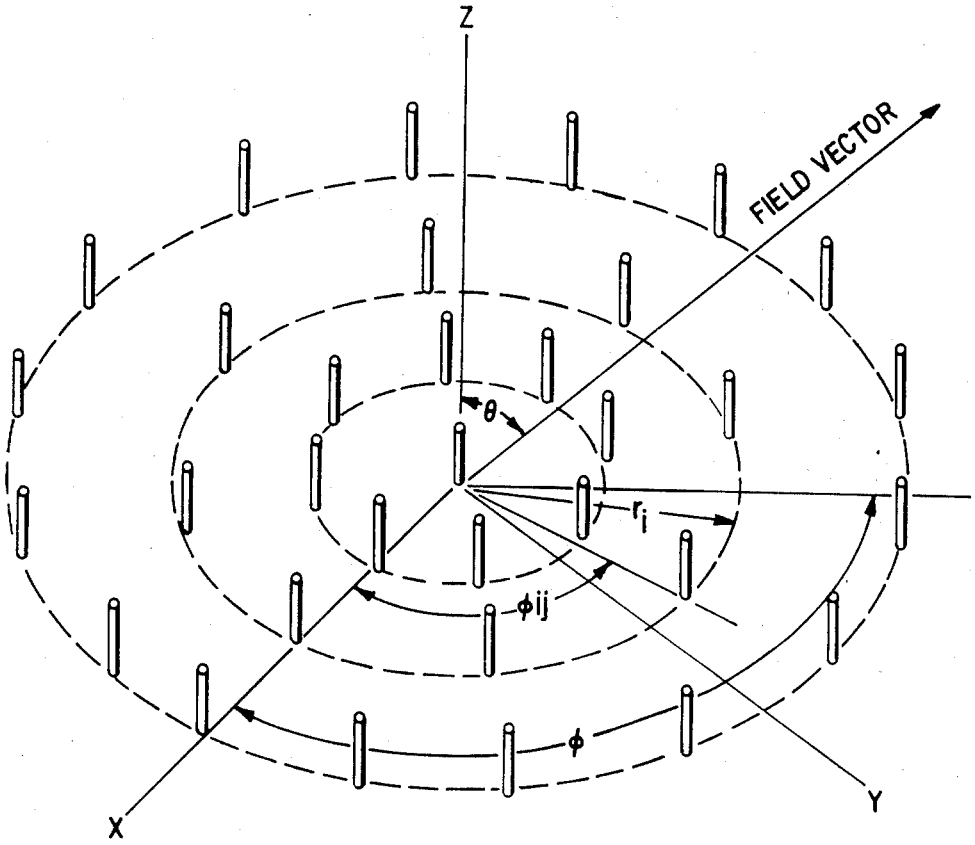
FIG. 1 is the co-ordinate system used in the description of theory of operation.

The theory of operation of the invention is described using the co-ordinate system of FIG. 1. Ignoring the effects of mutual coupling and blockage between elements, and the finite size of the ground plane, the total radiated field of the antenna array is given by $$E(\theta,\phi) = A(\theta,\phi) + KG(\theta,\phi) \sum_{i=1}^{N} \sum_{j=1}^{M(i)} F_{ij}(r_i,\phi_{ij},\theta,\phi)$$

where $\theta$ and $\phi$ are the angular co-ordinates of the field point in the elevation and azimuth planes respectively. $A(\theta, \phi)$ is the field radiated by the driven element. K is the complex scattering coefficient of the parasitic element. $G(\theta, \phi)$ is the radiation pattern of the parasitic element. $F_{ij}(r_i,\phi_{ij},\theta,\phi)$ is the complex function relating the amplitudes and phases of the driven and parasitic radiated fields. N is the number of rings of parasitic elements. M(i) is the number of parasitic elements in the i ring.

By activating the required number of parasitic elements at the appropriate $r_i,\phi_{ij}$ co-ordinates, the directivity and pointing of the antenna can be controlled electronically in both the azimuth and elevation planes. Mutual coupling and blockage between elements, and the finite size of the ground plane have, however, a significant effect on the antenna radiation patterns. Although there are some simple array configurations that can be devised by inspection, in general, the antenna is designed using an antenna wire grid modelling program in conjunction with experimental modelling techniques. It is important, particularly when high efficiency, wide bandwidth, and low sidelobe levels are design objectives, that the non-activated parasitic elements are electrically transparent to incident radiation i.e. the scattered fields are small in relation to the field scattered by an activated element.

Figure 2:
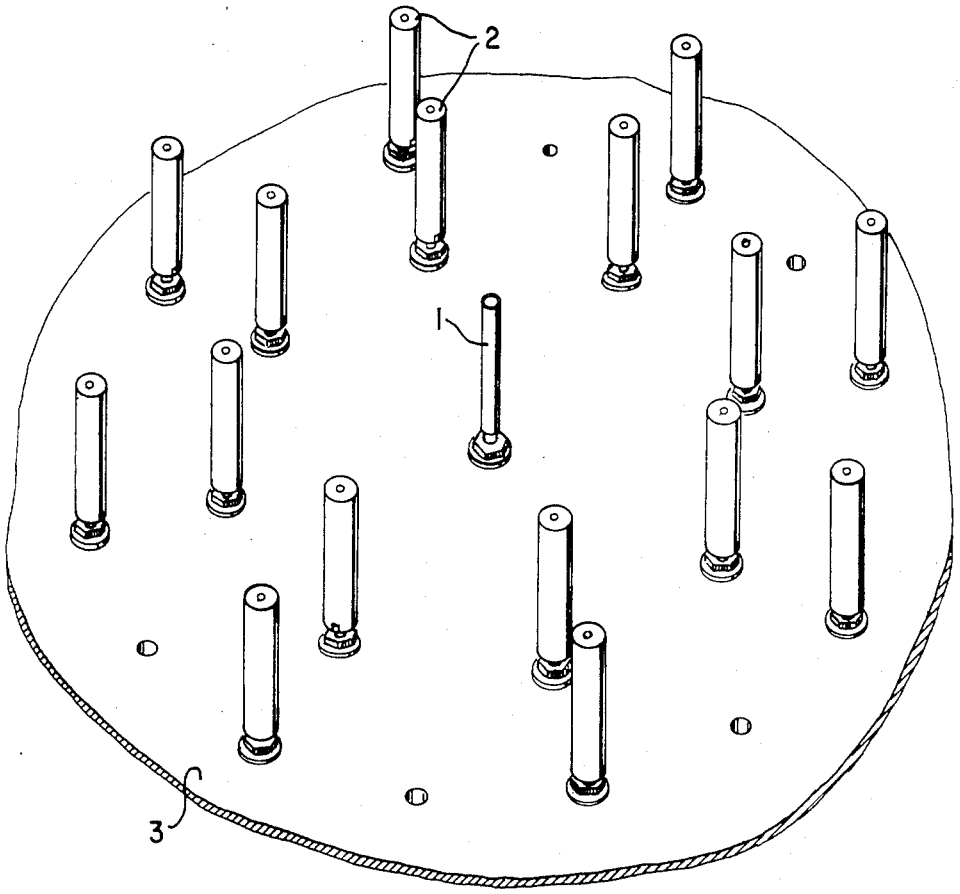
FIG. 2 is a perspective view showing the adaptive antenna constructed according to a first embodiment of the invention.

Referring to FIG. 2 it shows a small adaptive array antenna constructed according to a first embodiment of the present invention. As can be seen in the figure a driven element 1, and a plurality of parasitic elements 2, are arranged perpendicular to a ground plane 3 formed by an electrically conductive plate e.g. of brass, aluminum etc. The driven element is a $\lambda/4$ (quarterwave monopole). The parasitic elements are arranged in two concentric circles centred at the $\lambda/4$ monopole. The diameters of the inner and outer circles are approximately $(\frac{2}{3})\lambda$ and $\lambda$ respectively. In this embodiment there are 8 parasitic elements in each circle spaced at 45° intervals. The diameter of the ground plane is greater than $2.5\lambda$.

Figure 3:
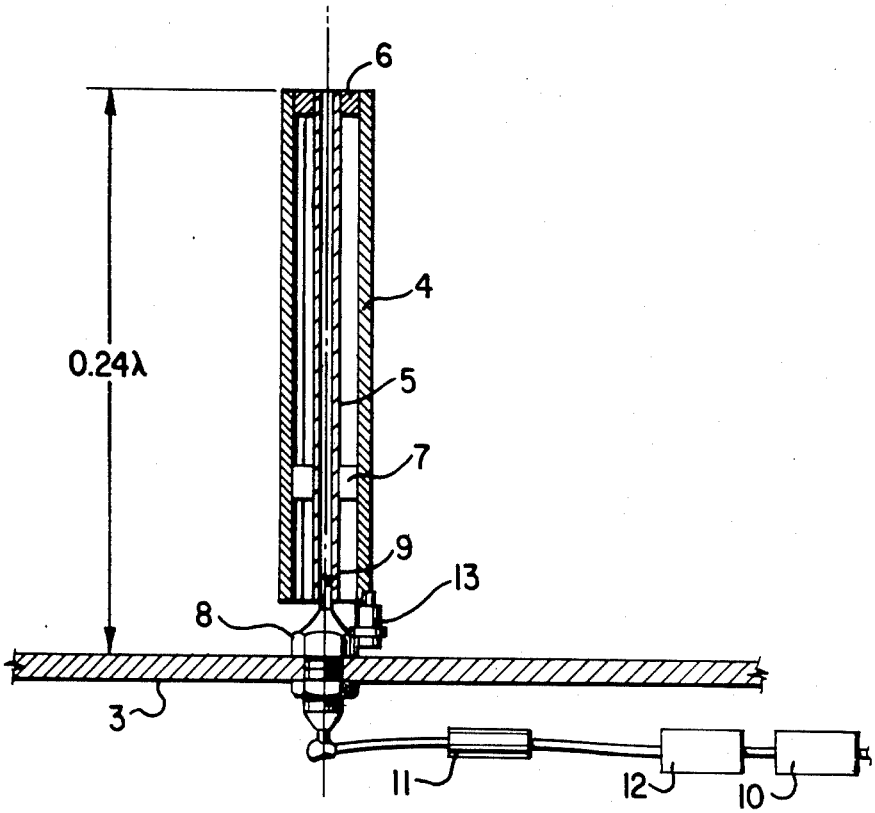
FIG. 3 is a schematic cross-sectional view of one of the parasitic elements shown in FIG. 2.

All the parasitic elements in this embodiment are identical. FIG. 3 is a schematic cross-section of one of the parasitic elements. In the figure, an outer cylindrical conductor 4 of, e.g. brass, and an inner cylindrical conductor 5 of, e.g. brass, form a coaxial line that is electrically shorted at one end with a shorting means 6. A dielectric spacer 7 of, e.g. Teflon (trademark) maintains the spacing of the conductors. A feedthrough capacitor 8 mounted on the ground plane 3 holds the parasitic element perpendicular thereto. One end of the centre conductor 9 of the feedthrough capacitor 8 is connected to the inner conductor 5 of the coaxial section. One or more pin diodes or equivalent switching means 13 depending the desired specification are connected between the outer conductor 4 of the coaxial line and the ground plane 3. By applying suitable biasing voltage supplied by a bias power supply 10 via biasing means made up of the biasing resistor 11 and the feedthrough capacitor 8 to the center conductor 9, the diodes can be made conducting or non-conducting, thus activating or deactivating the parasitic element. An antenna controller 12 is arranged between the power supply 10 and a plurality of the biasing means to control the application of the biasing voltage to one or more parasitic elements. The reflection properties of the parasitic elements can thereby be controlled by the antenna controller which can be microprocessor operated.

Figure 4:
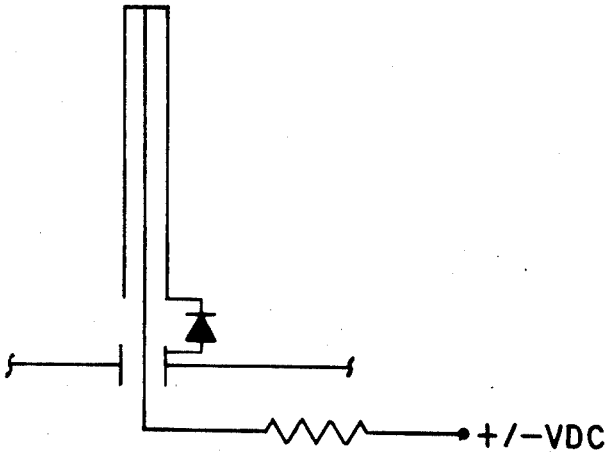
FIG. 4 is an electrical schematic diagram of the parasitic element shown in FIG. 3.

In this embodiment of the invention the parasitic element is a composite structure which acts as both radiator and RF choke and incorporates both the switching means and RF by-pass capacitor. The electrical schematic of the parasitic element is shown in FIG. 4.

The design objectives in this embodiment are to maximize the amplitude component of the reflection coefficient with minimum RF loss with the diode "on", and to minimize the amplitude component with the diode "off" i.e. the parasitic element should be essentially transparent to incident radiation. To achieve the former objective the parasitic element operates at or near resonance. In this embodiment the height of the element above the ground plane is $0.24\lambda$. The transparency of the parasitic element in the "off" state is determined by the length of the isolated element and the impedance between the element and ground plane. The amplitude component of the reflection coefficient of an isolated dipole with a length less than $0.25\lambda$ is however very small in comparison to a resonant monopole. The impedance between the element and the ground plane is largely determined by the diode capacitance, the fringing capacitance between the end of the element and ground, and the RF impedance presented by the biasing means. In the microwave frequency range this impedance can have a major effect on the array design.

The input impedance of a lossless shorted section of coaxial line with air dielectric is given by $$Z = j138\left(\log_{10}\frac{b}{a}\right)\tan Bl$$

where b and a are the outer and inner radii of the conductors l is the effective length of the coaxial line and $B=2\pi/\lambda$ For lengths of line less than λ/4 the impedance is inductive. To achieve high levels of impedance between the parasitic element and the ground plane, the inductance of the RF choke formed by the shorted coaxial section, can be designed to resonate with the diode and fringing capacitances. Useful operating bandwidths of greater than 20% can be achieved.

Figure 5A:
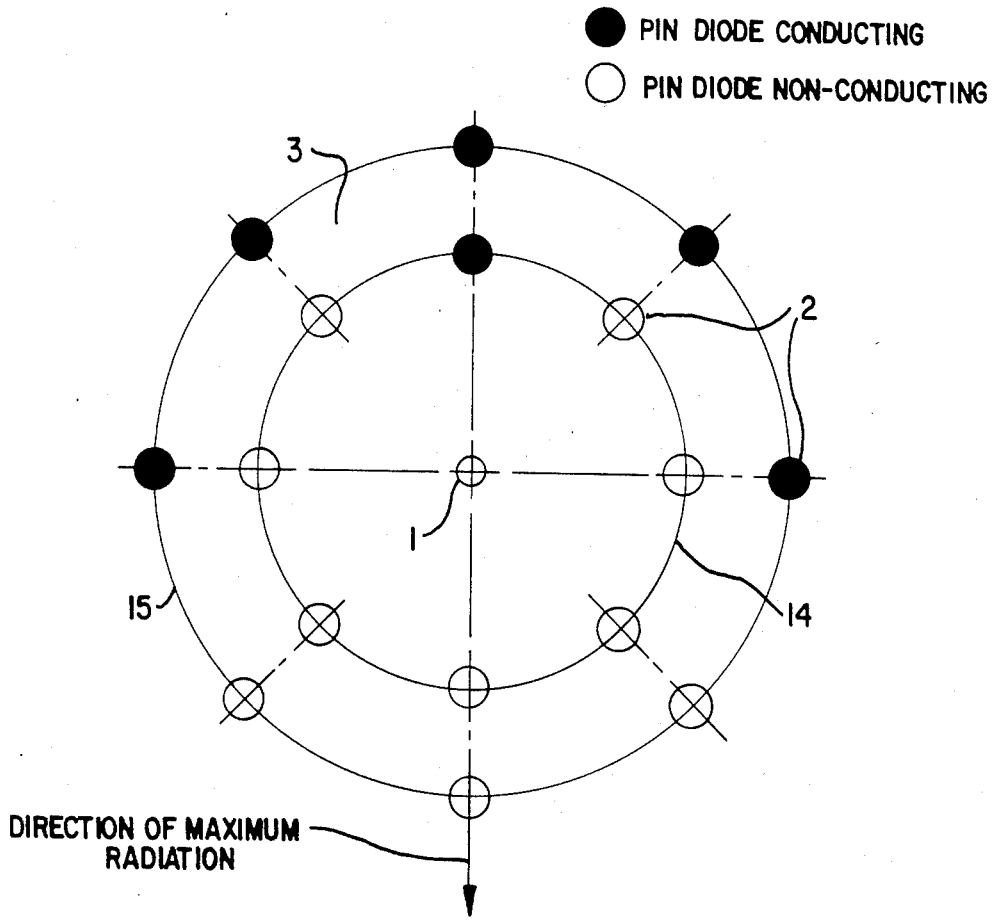
FIGS. 5*a*, 5*b* and 5*c* are biasing configurations for the first embodiment of the invention.
Figure 5B:
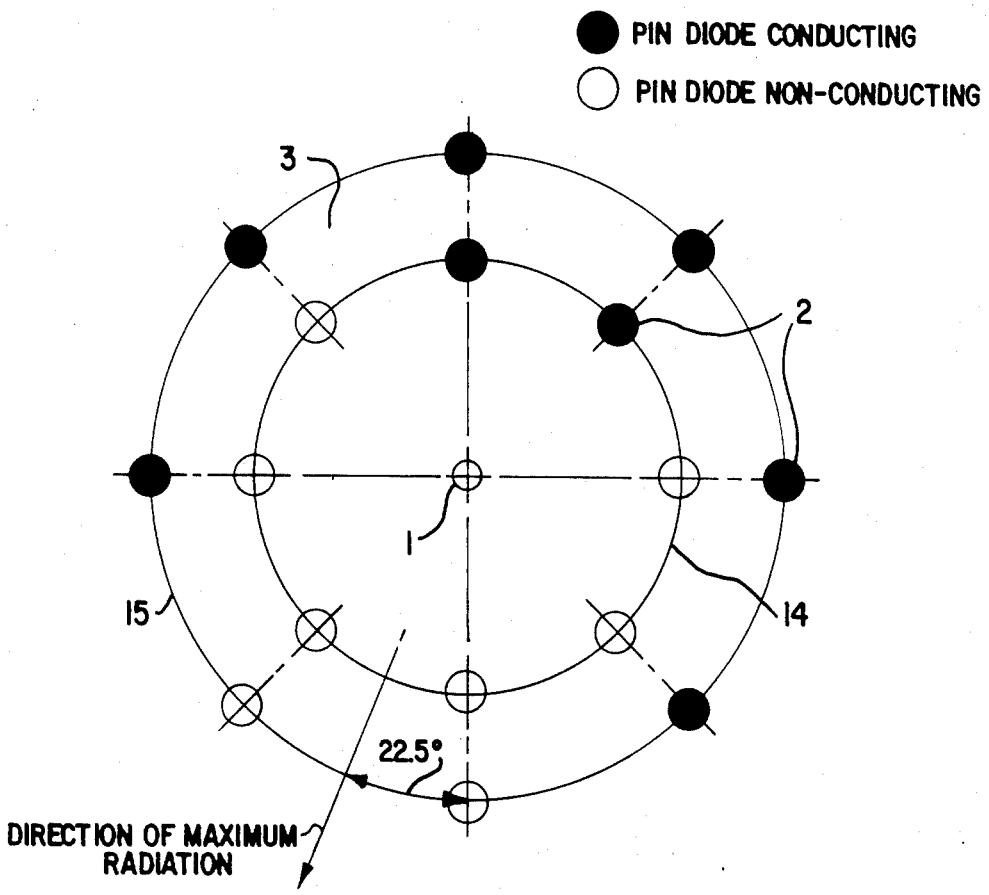
Figure 6:
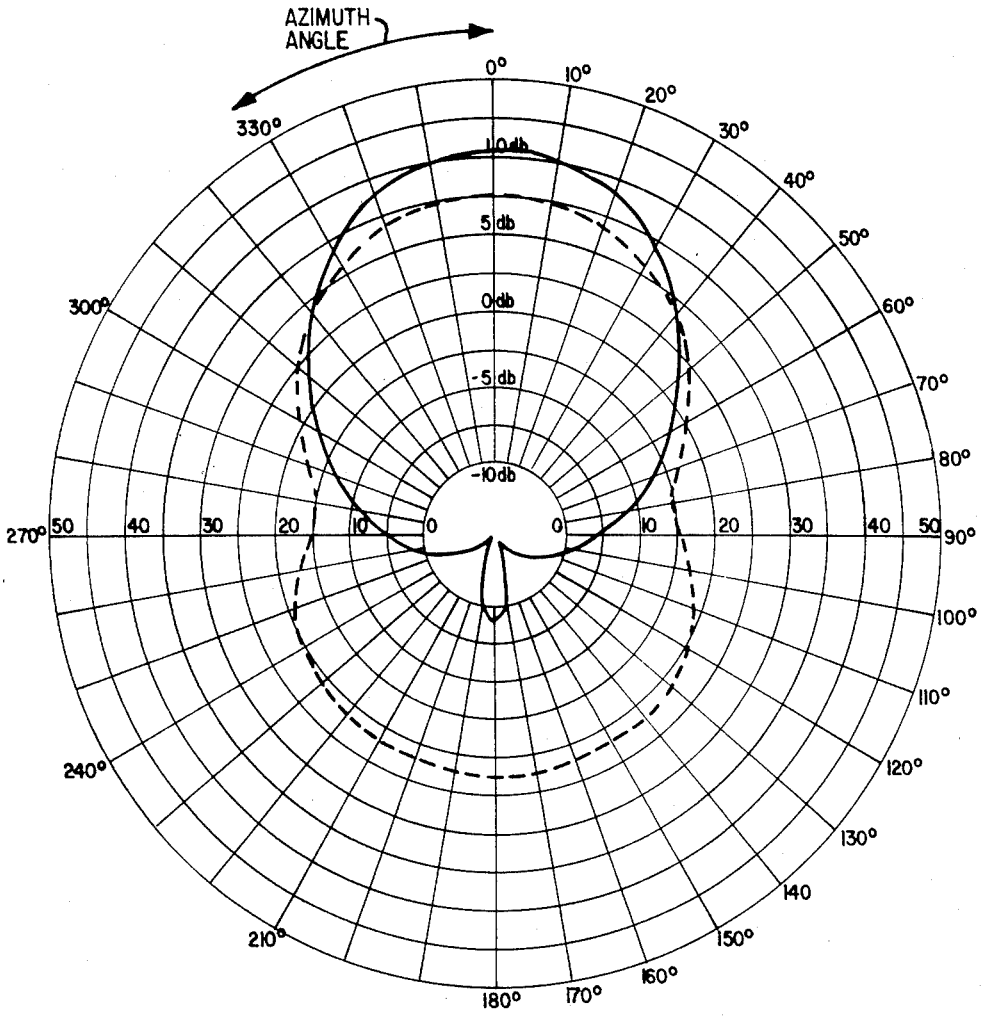
FIG. 6 are the azimuth radiation patterns of the first embodiment at midband frequency.
Figure 7:
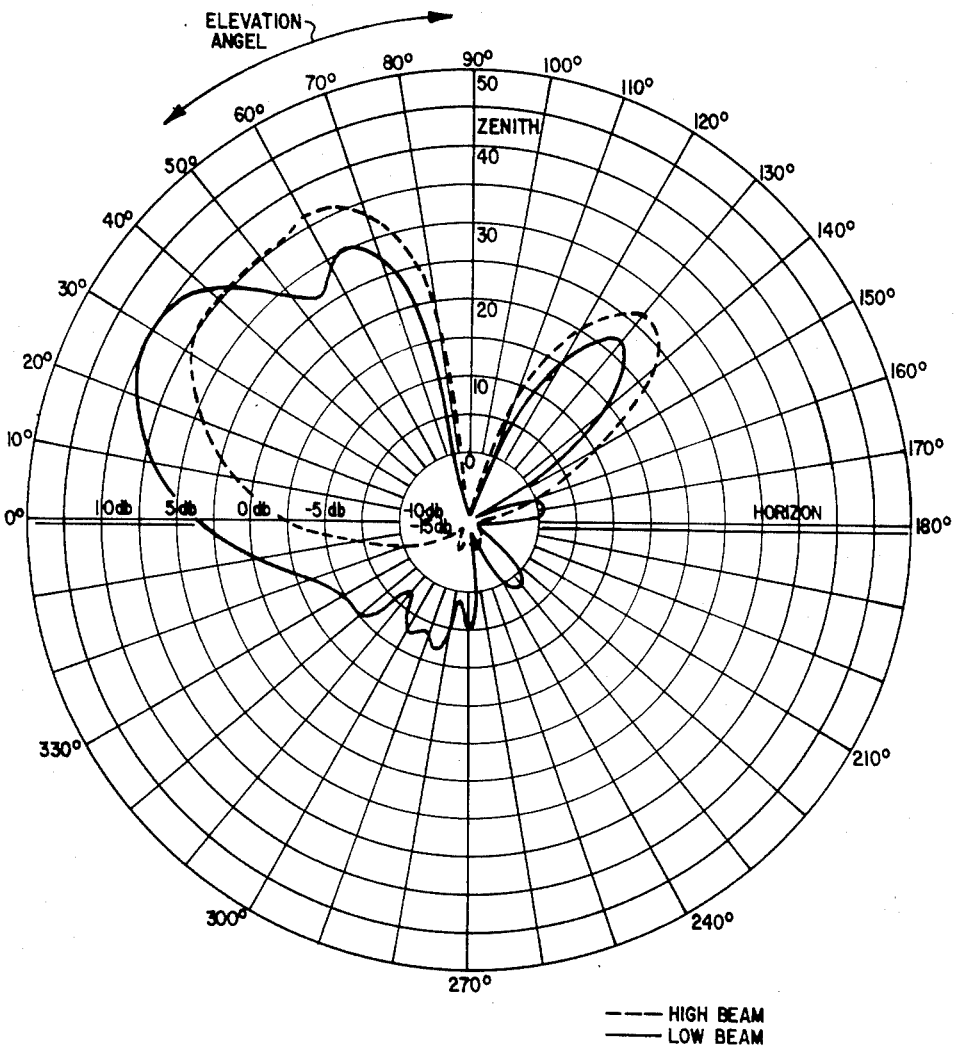
FIG. 7 are the elevation radiation patterns of the first embodiment at midband frequency.

By applying suitable biasing means to the appropriate parasitic elements it is possible to generate a number of different radiation patterns of variable directivity and orientation in both the azimuth and elevation planes. FIGS. 5*a* and 5*b* show the bias configurations that will generate a "low" elevation antenna beam suitable for high latitude countries such as Canada in that the antenna pattern in optimized between 10° and 35° in elevation. The "low" beam azimuth and elevation radiation patterns are shown in FIGS. 6 and 7 respectively. In FIG. 5*a*, 5 parasitic elements in the outer circle 15 and one in the inner circle 14 are activated by switching the respective pin diodes to be conducting. All other pin diodes are non conducting. The azimuth direction of maximum radiation is due South as indicated in the figure. Because of the array symmetry, the antenna pattern can be stepped in increments of 45° by simply rotating the bias configuration. It is also possible to rotate the beam in azimuth by activating additional parasitic elements as shown in FIG. 5*b*. By activating one additional parasitic element in each circle the radiation pattern can be rotated Westward by 22.5° without any significant change in elevation and azimuth pattern shape. By alternating between the bias configurations of 5*a* and 5*b* the antenna beam can be rotated stepwise in Azimuth in increments of 22.5°.

Figure 5C:
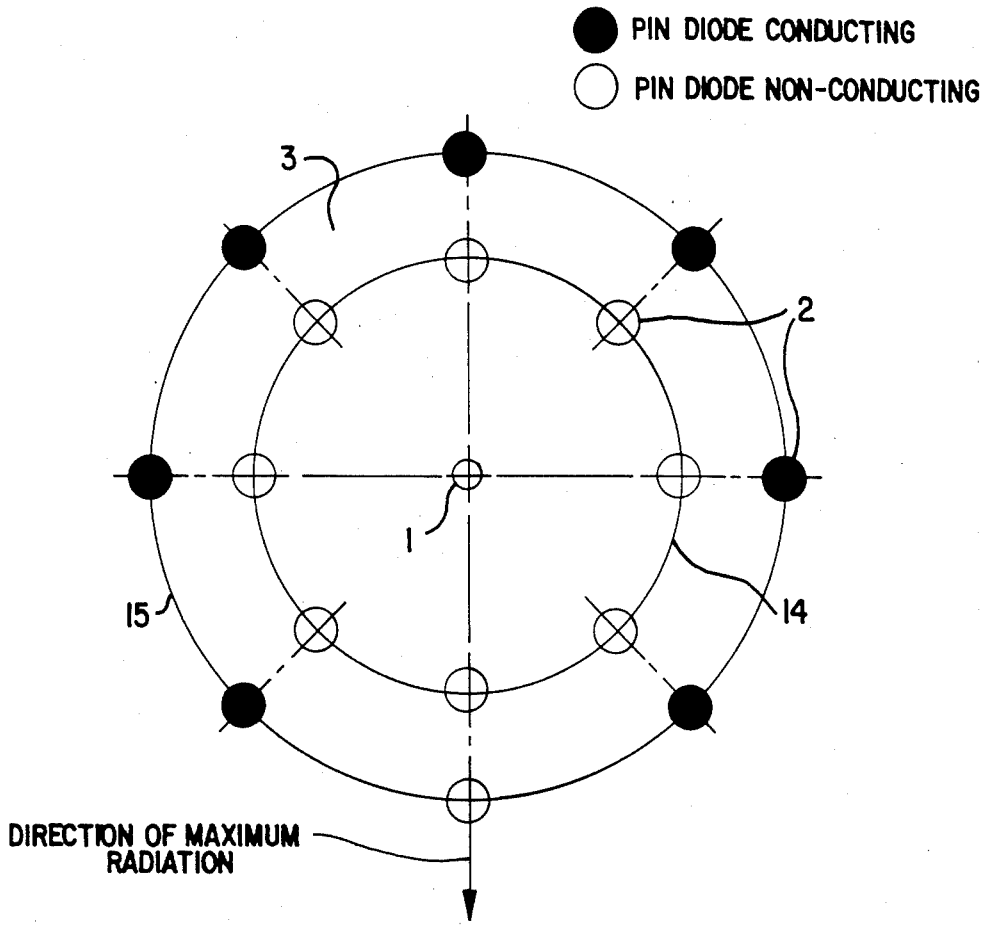

FIG. 5*c* shows a bias configuration that will generate a "high" elevation beam suitable for mid latitude countries such as the U.S.A. in that the antenna pattern is optimized between 30° and 60° in elevation. The high beam azimuth and elevation radiation patterns at midband frequency are shown in FIGS. 6 and 7 respectively. In FIG. 5*c* seven parasitic elements in the outer circle 15 are activated causing the respective pin diodes to be conducting. All other pin diodes are non-conducting. The azimuth direction of maximum radiation is due South as indicated in the figure. Because of array symmetry the antenna beam can be stepwise rotated in azimuth in increments of 45° by rotating the bias configuration of FIG. 5*c*.

Figure 8:
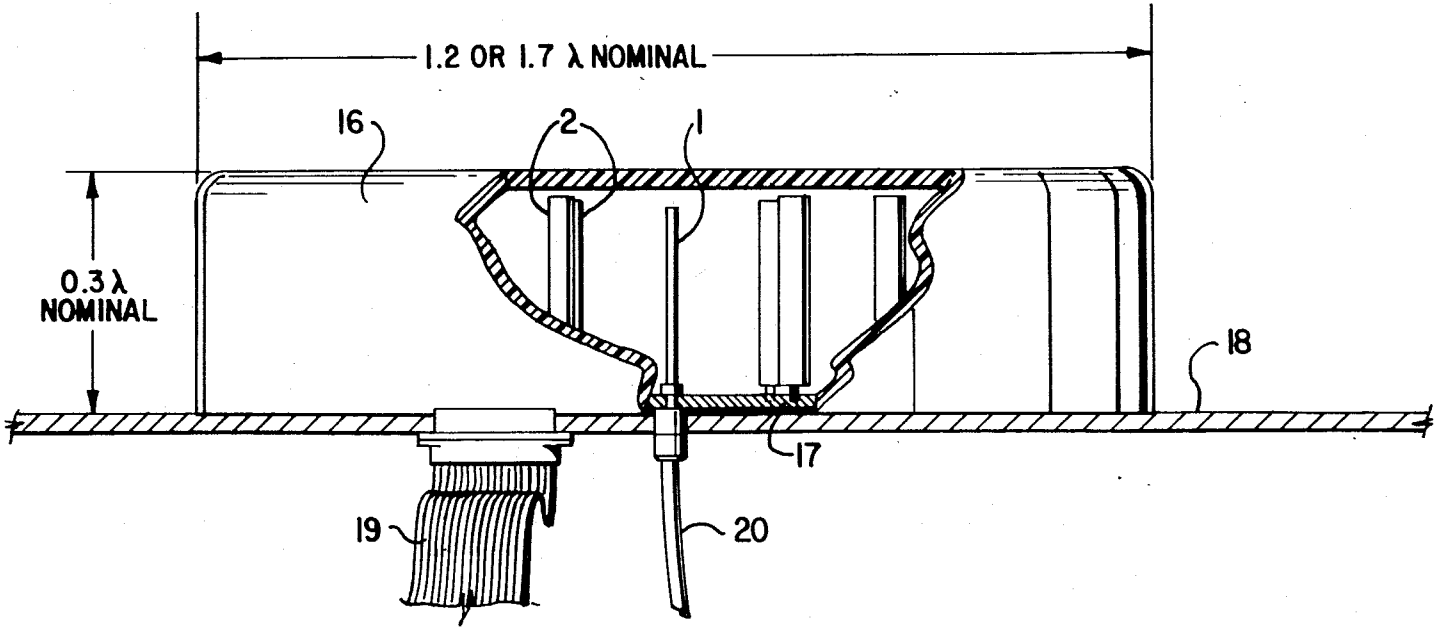
FIG. 8 is a perspective view of an antenna assembly as installed on a mobile terminal.

A practical embodiment of this invention was designed built and field tested for satellite-mobile communications applications operating at 1.5 GHz. The measured "low" and "high" beam radiation patterns at midband frequency are shown in FIGS. 6 and 7. Table 1 annexed at the end of this disclosure shows typical measured linearly polarized gains versus elevation angle for both the "low" and "high" beams for any azimuth angle. An effective ground plane size greater than 2.5λ diameter is required if the gain values in Table 1 are to be realized at low elevation angles. No serious degradation in gain, pointing or pattern shape occurred over a frequency bandwidth of about 12%. A V.S.W.R. of less than 2:1 was measured using the bias configurations of 5*a*, 5*b* and 5*c*. The antenna was designed to handle a maximum transmitted RF power of 200 watts. FIG. 8 is a perspective view of the antenna assembly as mounted on a mobile terminal. The antenna elements 1 and 2 are enclosed in a protective radome 16, nominally 1.2λ in diameter and 0.3λ in height made of such low RF loss material as plastic, fibreglass, etc. A substructure 17 is bolted to the metallic body 18 of the mobile terminal which provides an effective ground plane. The substructure 17 provides both a mechanical and electrical interface with the array elements and mobile terminal structure. A control cable for the parasitic elements is shown at 19 and an RF cable 20 is connected to the driven λ/4 monopole.

Figure 9:
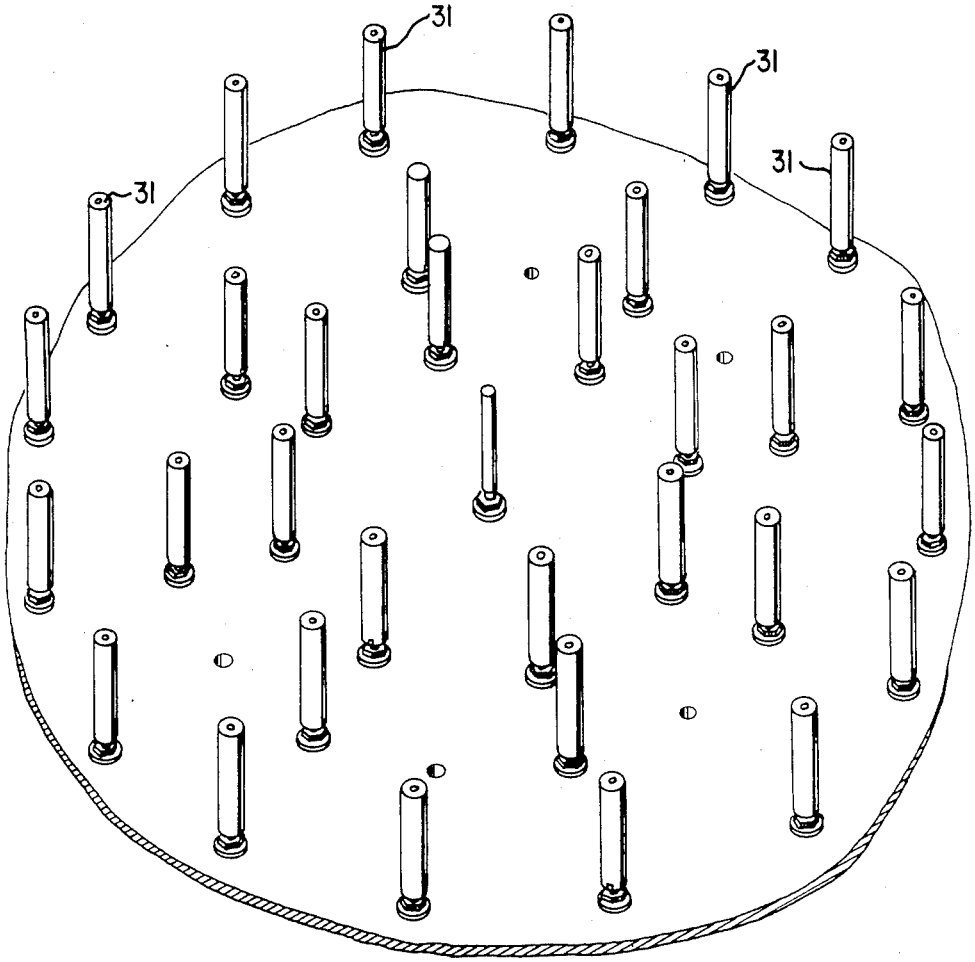
FIG. 9 is a perspective view showing the adaptive array antenna constructed according to a second embodiment of the invention.

FIG. 9 shows a small adaptive array antenna constructed according to a second embodiment of the present invention. The array antenna has a higher directivity and gain by virtue of having a larger array of parasitic elements when compared to the first embodiment. The parasitic elements are arranged in 3 concentric circles centred at the λ/4 monopole. The diameters of the circles are approximately $(\frac{2}{3})\lambda$, λ and 1.5λ. In the embodiment there are 8 parasitic elements spaced at 45° intervals in each of the two inner circles and 16 parasitic elements 31, spaced at 22.5° intervals in the outer circle.

Figure 10A:
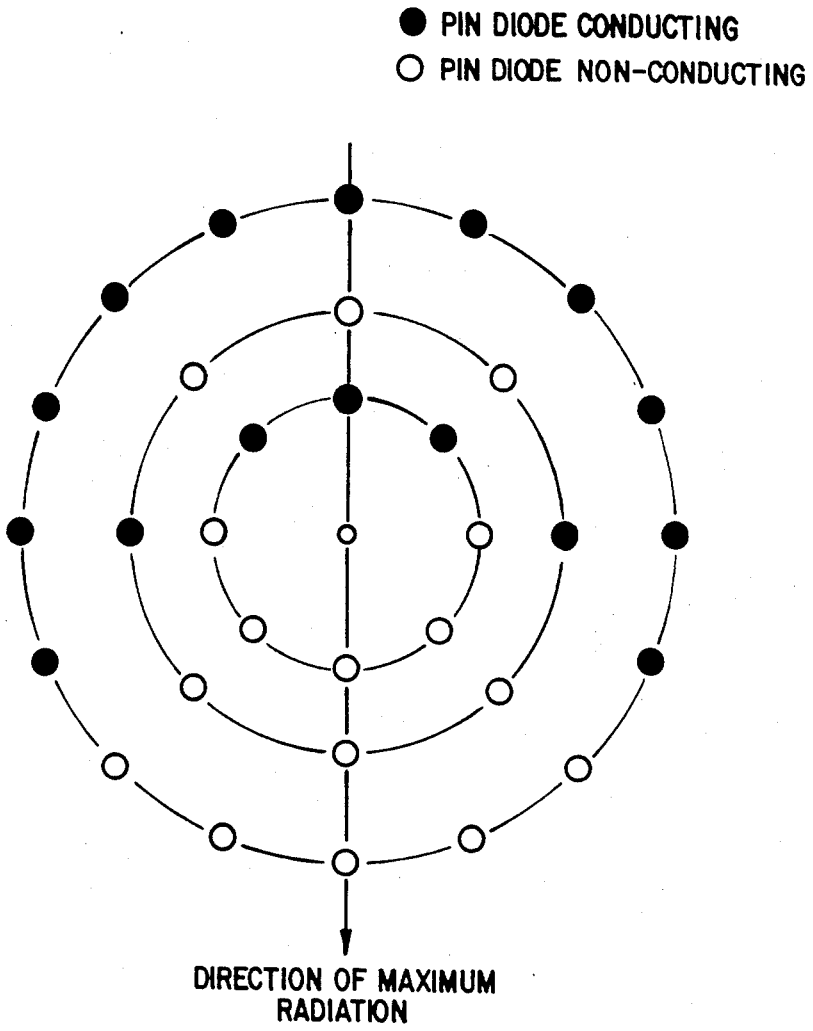
FIGS. 10*a*, 10*b*, 10*c* and 10*d* are the biasing configurations for the second embodiment of the invention.
Figure 10B:
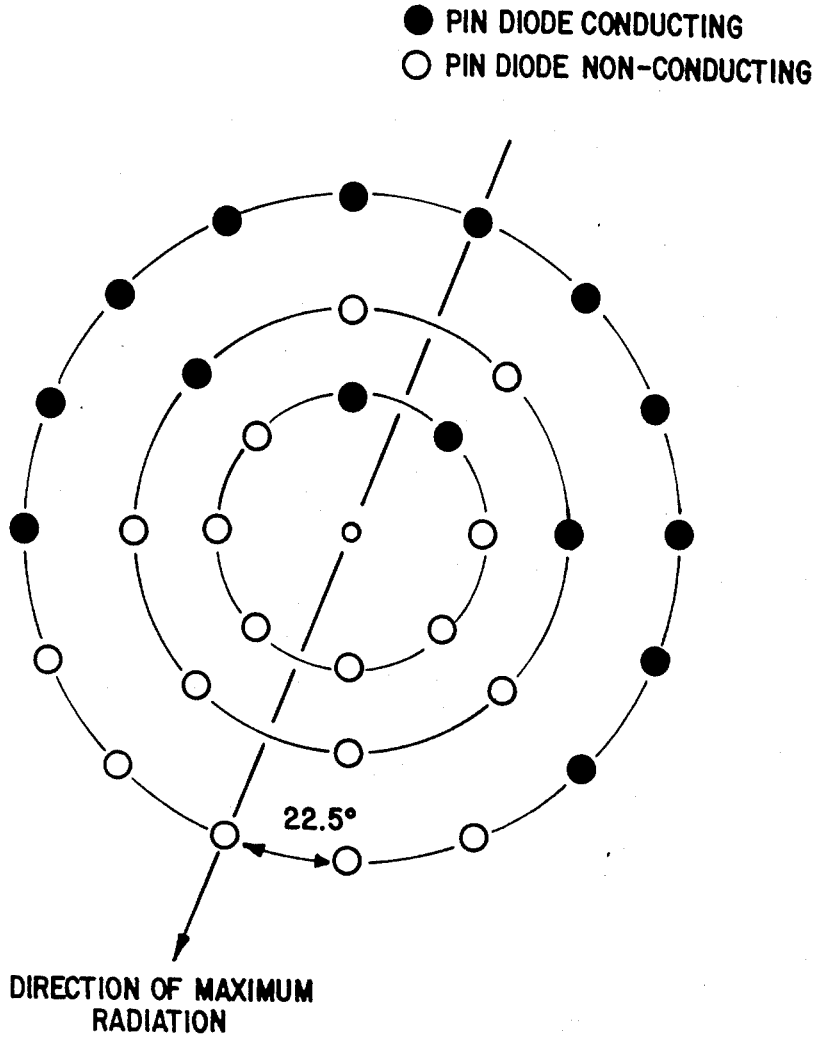
Figure 10C:
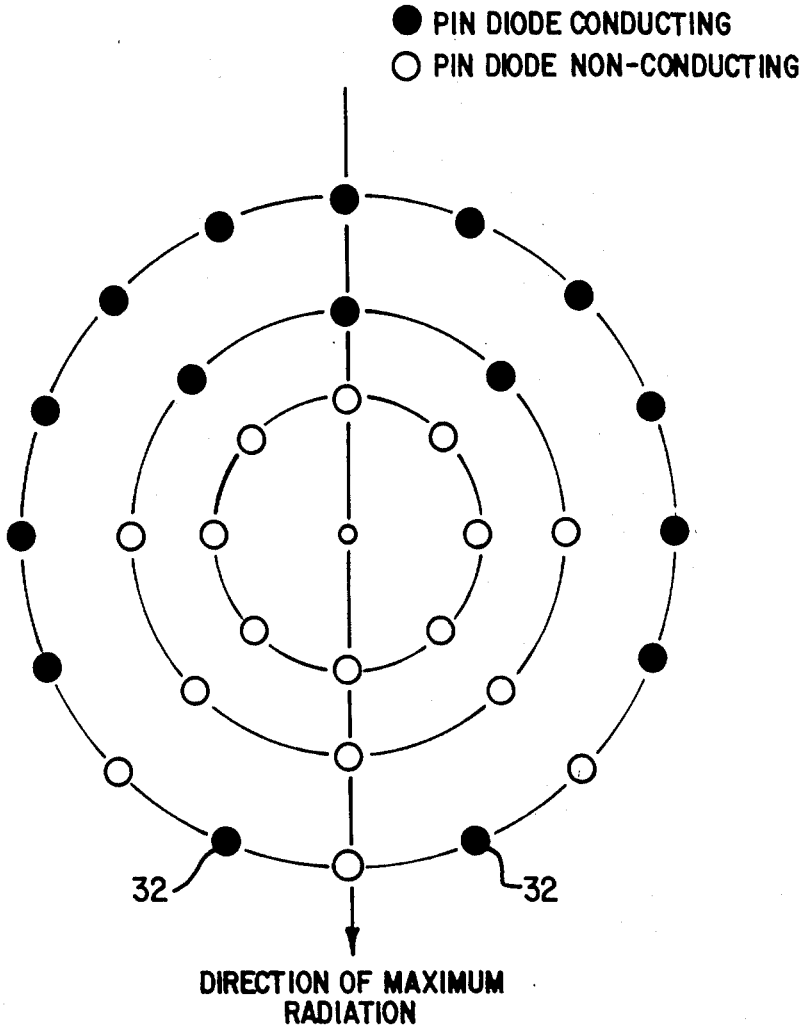
Figure 10D:
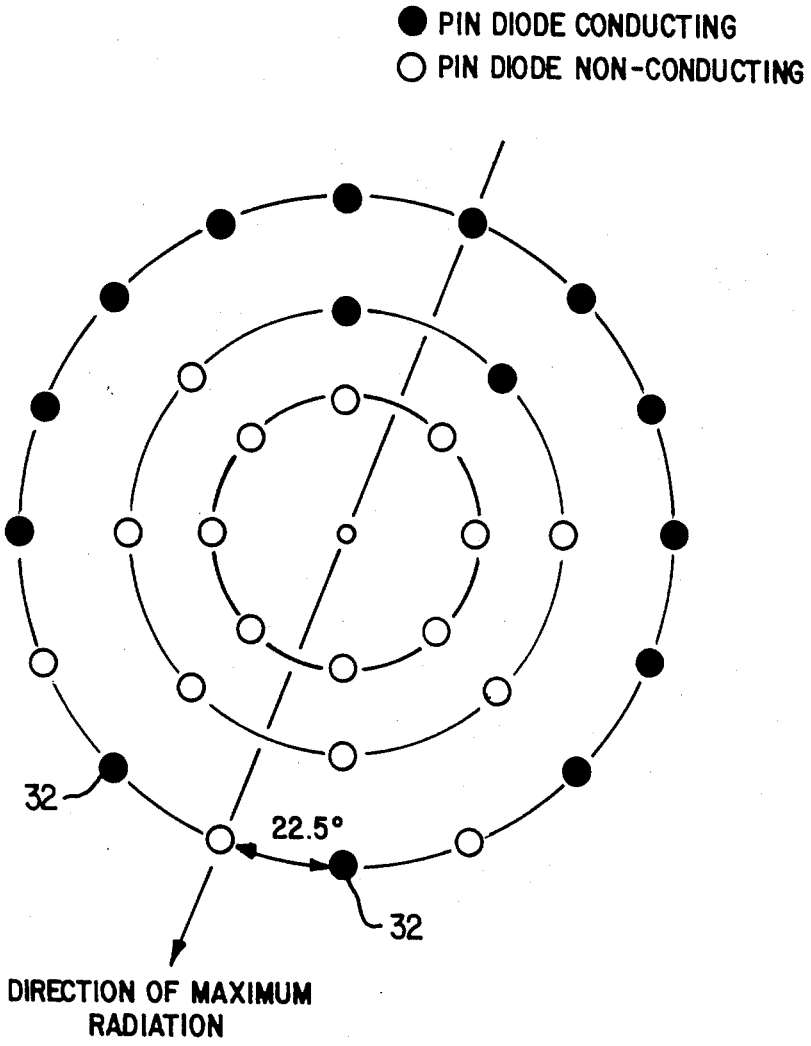
Figure 11:
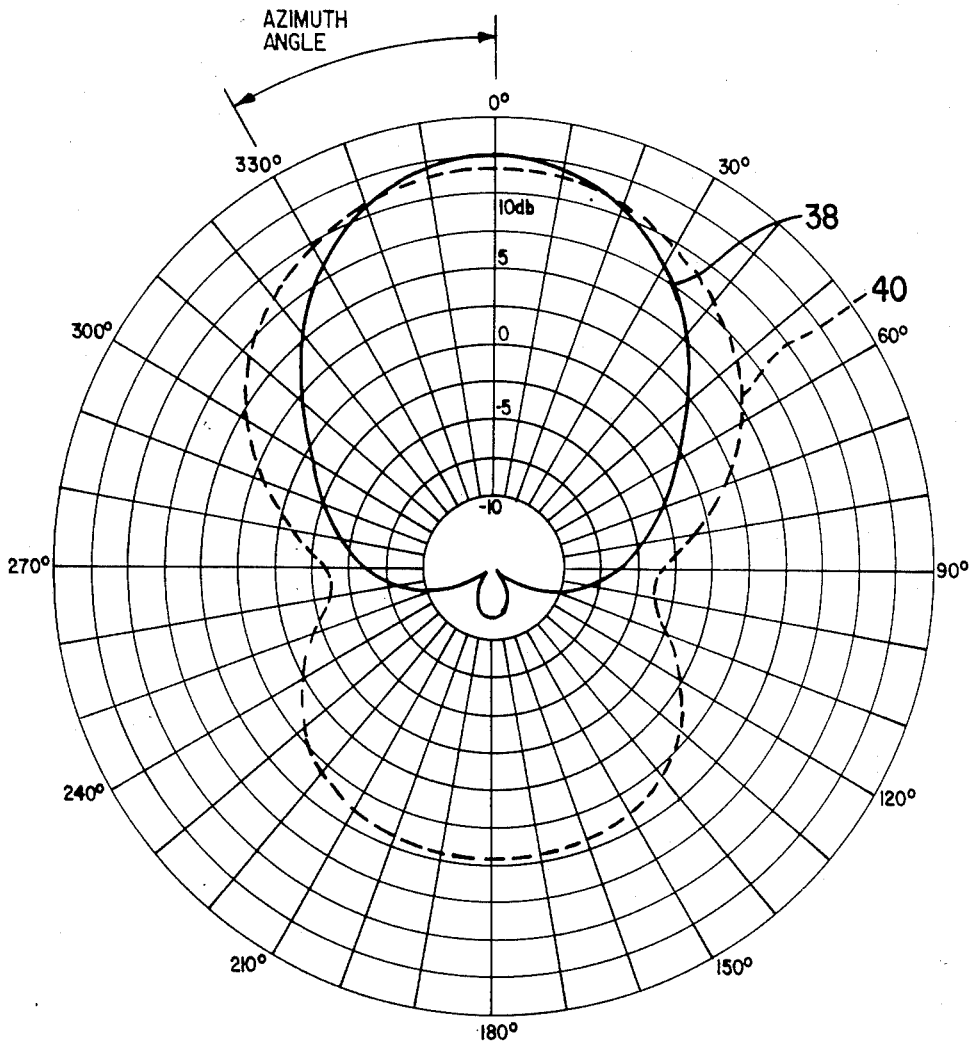
FIG. 11 are the Azimuth radiation patterns of the second embodiment at midband frequency.
Figure 12:
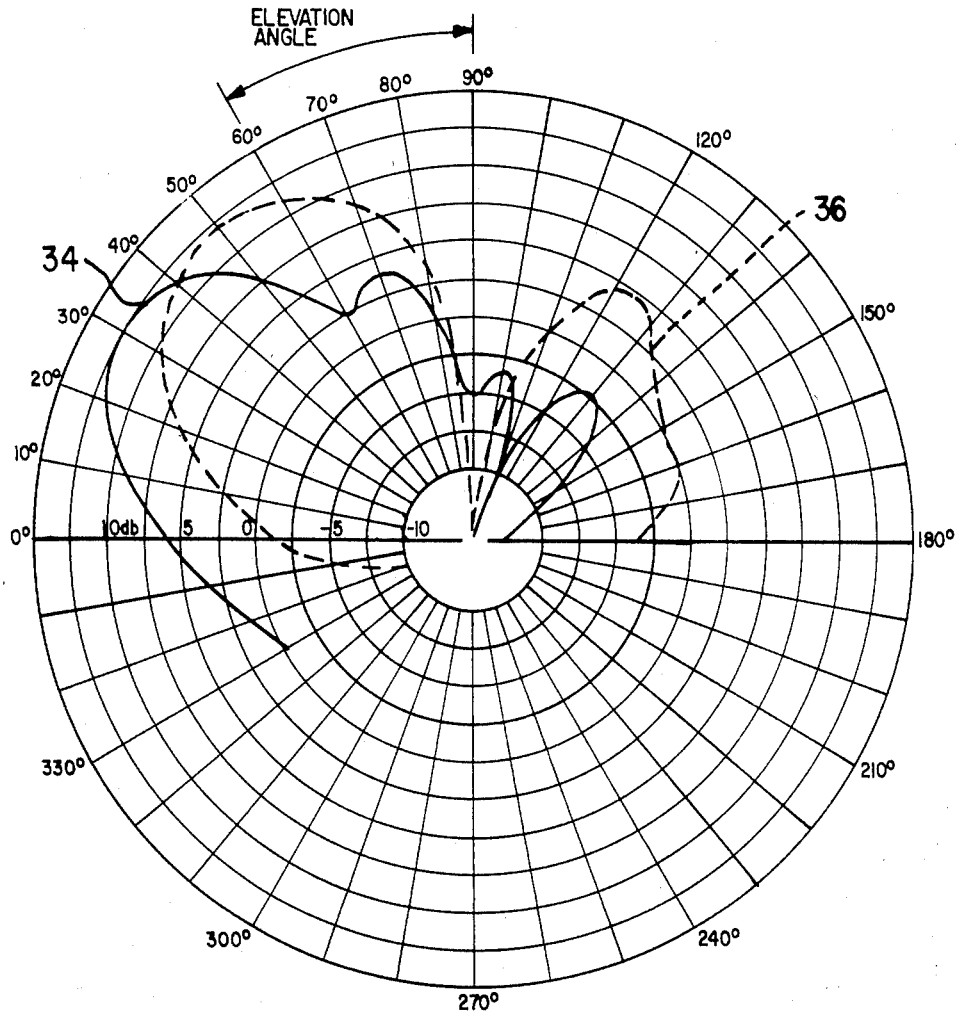
FIG. 12 are the Elevation radiation patterns of the second embodiment at midband frequency.

FIGS. 10*a* and 10*b* show the bias configurations that will generate a "low" elevation beam while FIGS. 10*c* and 10*d* show the bias configurations for a "high" elevation beam. By alternating between the bias configurations of 10*a* and 10*b*, and between 10*c* and 10*d*, the low and high elevation beams can be stepped in azimuth respectively. It should be noted that the parasitic elements designated 32 in FIGS. 10*c* and 10*d* are activated to deflect the beam in the elevation plane, enhancing the gain of the high beam configuration. FIG. 11 shows the azimuth radiation patterns at midband frequency where the solid line 38 is the low elevation beam measured at a constant elevation angle of 30° and the broken line 40 of the high elevation beam measured at a constant elevation angle of 55°. FIG. 12 shows the elevation radiation patterns at midband frequency where the solid line 34 and the broken line 36 are the low and high beams respectively.

A practical embodiment of the invention was designed built and field tested for satellite-mobile communications applications at 1.5 GHz. The measured low and high beam radiation patterns at midband frequency are shown in FIGS. 11 and 12. Table 2 to be found at the end of this disclosure shows typical measured linearly polarized gains versus elevation angle for both the low and high beams for any azimuth angle. An effective groundplane size greater than 3λ diameter is required if the gain values in Table 2 are to be realized at low elevation angles. No serious degradation in gain, pointing or pattern shape of the low and high beams occurred over frequency bandwidths of about 20% and 10% respectively. A V.S.W.R. of less than 2.5:1 was measured using the bias configurations of 10*a*, 10*b*, 10*c* and 10*d*. In the perspective view of the antenna assembly shown in FIG. 8, the diameter and height of the radome were 1.7λ and 0.3λ respectively.

TABLE 1

Measured Antenna Linearly Polarized Gains

| Elevation Angle (°) | Low Beam Gain (dbi) | High Beam Gain (dbi) |
|---|---|---|
| 0 | 3.9 | −2.50 |
| 5 | 5.6 | −0.25 |
| 10 | 7.0 | 1.50 |
| 15 | 8.0 | 3.00 |
| 20 | 9.1 | 4.75 |
| 25 | 9.6 | 5.50 |
| 30 | 9.8 | 6.90 |
| 35 | 9.5 | 7.40 |
| 40 | 8.50 | 7.60 |
| 45 | 6.30 | 7.40 |
| 50 | 3.70 | 7.25 |

TABLE 1-continued

| Measured Antenna Linearly Polarized Gains | | |
|---|---|---|
| Elevation Angle (°) | Low Beam Gain (dbi) | High Beam Gain (dbi) |
| 55 | 3.00 | 7.30 |
| 60 | 4.30 | 7.70 |
| 65 | 4.90 | 7.60 |
| 70 | 3.50 | 6.60 |

TABLE 2

| Measured Linearly Polarized Antenna Gains | | |
|---|---|---|
| Elevation Angle (°) | Low Beam Gain (dbi) | High Beam Gain (dbi) |
| 0 | 6.4 | −4.9 |
| 5 | 7.7 | −2.6 |
| 10 | 9.0 | 0.4 |
| 15 | 10.3 | 2.4 |
| 20 | 11.0 | 4.4 |
| 25 | 11.7 | 6.2 |
| 30 | 11.9 | 7.7 |
| 35 | 11.7 | 9.4 |
| 40 | 11.0 | 10.1 |
| 45 | 9.6 | 10.7 |
| 50 | 7.0 | 11.0 |
| 55 | 4.0 | 10.7 |
| 60 | 1.9 | 10.5 |
| 65 | 2.8 | 9.4 |
| 70 | 3.4 | 8.2 |

I claim:

1. A small array antenna comprising:

a ground plane formed by an electrical conductive plate, a driven quarter-wave (λ/4) monopole positioned substantially perpendicularly to the ground plane, a plurality of coaxial parasitic elements, each positioned substantially perpendicularly to but electrically insulated from the ground plane and further arranged in a predetermined array pattern on the ground plane in relation to each other and to the driven monopole, each of the coaxial parasitic elements having two ends, the first end being nearer to the ground plane than the second end and comprising an inner electrical conductor and an outer cylindrical electrical conductor, the inner conductor being within and coaxially spaced from the outer cylindrical electrical conductor and the said conductors being electrically shorted with each other at the second end, a plurality of switching means, each connected between the outer cylindrical electrical conductor of each coaxial parasitic element at its first end and the ground plane, a cable connected to the driven monopole to feed RF energy thereto, a plurality of biasing means each electrically connected to the inner electrical conductor of each coaxial parasitic element at its first end, and an antenna controller connecting the plurality of the biasing means and a bias power supply to cause one or more of the switching means to be either electrically conducting or non-conducting so that the antenna pattern can be altered.

2. The small array antenna of claim 1 wherein each of the switching means comprises one or more pin diodes.

3. The small array antenna of claim 2 wherein each of the said biasing means comprises a feed-through capacitor mounted on the ground plane and connected to the inner electrical conductor of the parasitic element and a biasing resistor connected to the feed-through capacitor.

4. The small array antenna of claim 3 wherein the antenna controller is microprocessor-controlled electronic switches.

5. The small array antenna of claim 1 wherein eight parasitic elements, each of which is approximately 0.24λ in length, are arranged equidistantly in each of two concentric circles whose diameters are approximately $(\frac{2}{3})\lambda$ and λ respectively and the driven monopole is located at the center of the circles, the parasitic elements in one of the circles coinciding radially with those in the other circle.

6. The small array antenna of claim 2 wherein eight parasitic elements, each of which is approximately 0.24λ in length, are arranged equidistantly in each of two concentric circles whose diameters are approximately $(\frac{2}{3})\lambda$ and λ respectively and the driven monopole is located at the center of the circles, the parasitic elements in one of the circles coinciding radially with those in the other circle.

7. The small array antenna of claim 3 wherein eight parasitic elements, each of which is approximately 0.24λ in length, are arranged equidistantly in each of two concentric circles whose diameters are of approximately $(\frac{2}{3})\lambda$ and λ respectively and the driven monopole is located at the center of the circles, the parasitic elements in one of the circles coinciding radially with those in the other circle.

8. The small array antenna of claim 4 wherein eight parasitic elements, each of which is aproximately 0.24λ in length, are arranged equidistantly in each of two concentric circles whose diameters are approximately $(\frac{2}{3})\lambda$ and λ respectively and the driven monopole is located at the center of the circles, the parasitic elements in one of the circles coinciding radially with those in the other circle.

9. The small array antenna of claim 5 further comprising:

additional 16 parasitic elements being arranged equidistantly in a third concentric circle whose diameter is approximately $(\frac{2}{3})\lambda$.

10. The small array antenna of claim 6 further comprising:

additional 16 parasitic elements being arranged equidistantly in a third concentric circle whose diameter is approximately $(\frac{2}{3})\lambda$.

11. The small array antenna of claim 7 further comprising:

additional 16 parasitic elements being arranged equidistantly in a third concentric circle whose diameter is approximately $(\frac{2}{3})\lambda$ and eight of the 16 parasitic elements coinciding radially with those in the other circles.

12. The small array antenna of claim 8 further comprising:

additional 16 parasitic elements being arranged equidistantly in a third concentric circle whose diameter is approximately $(\frac{2}{3})\lambda$ and eight of the 16 parasitic elements coinciding radially with those in the other circles.

* * * * *

UNITED STATES PATENT AND TRADEMARK OFFICE

CERTIFICATE OF CORRECTION

PATENT NO. : 4,700,197

DATED : Oct. 13, 1987

INVENTOR(S) : Robert Milne

It is certified that error appears in the above-identified patent and that said Letters Patent are hereby corrected as shown below:

Claim 9, line 5, "$(\frac{2}{3})\lambda$" should read --$(\frac{3}{2})\lambda$--.

Claim 10, line 5, "$(\frac{2}{3})\lambda$" should read --$(\frac{3}{2})\lambda$--.

Claim 11, line 5, "$(\frac{2}{3})\lambda$" should read --$(\frac{3}{2})\lambda$--.

Claim 12, line 5, "$(\frac{2}{3})\lambda$" should read --$(\frac{3}{2})\lambda$--.

Signed and Sealed this

First Day of March, 1988

*Attest:*

*Attesting Officer*

DONALD J. QUIGG

*Commissioner of Patents and Trademarks*